US010467849B1

(12) United States Patent
Furlan

(10) Patent No.: US 10,467,849 B1
(45) Date of Patent: Nov. 5, 2019

(54) ELECTRONIC POKER GAMEPLAY APPARATUS AND GAMING TOKEN SET USABLE WITH THE GAMEPLAY APPARATUS

(71) Applicant: Jesse G. Furlan, Winnipeg (CA)

(72) Inventor: Jesse G. Furlan, Winnipeg (CA)

( * ) Notice: Subject to any disclaimer, the term of this patent is extended or adjusted under 35 U.S.C. 154(b) by 0 days.

(21) Appl. No.: 16/111,609

(22) Filed: Aug. 24, 2018

(51) Int. Cl.
*G07F 17/32* (2006.01)

(52) U.S. Cl.
CPC ..... *G07F 17/323* (2013.01); *G07F 17/322* (2013.01); *G07F 17/3293* (2013.01)

(58) Field of Classification Search
None
See application file for complete search history.

(56) References Cited

U.S. PATENT DOCUMENTS 7,351,145 B1 * 4/2008 Ornstein ..... 273/309
8,167,705 B2 * 5/2012 Jorasch ..... A44C 21/00 273/139
2008/0036147 A1 * 2/2008 Hostettler ..... A63F 3/00697 273/288
2014/0338986 A1 * 11/2014 Crist ..... G01G 19/42 177/1

* cited by examiner

*Primary Examiner* — Ronald Laneau
(74) *Attorney, Agent, or Firm* — Ryan W. Dupuis; Ade & Company Inc.; Kyle R. Satterthwaite

(57) ABSTRACT

An apparatus with sensors and displays to be used with specifically weighted gaming tokens in order to provide useful information during a game of poker. All gaming tokens formed in a poker pot are contained in a gaming token receiving receptacle. The gaming tokens are weighed and the total monetary value of tokens within the receptacle is determined based on the total weight of the gaming tokens within the receptacle. The weights of the gaming tokens in the set are manufactured such that the weight of any gaming token and the assigned monetary value of that gaming token is identical among all gaming tokens of the gaming token set. The apparatus displays both the total monetary value of gaming tokens in the receptacle and the total value of gaming tokens that were previously added to the receptacle. The apparatus also displays the time remaining until the value of the blinds needs to be increased. The timer automatically resets at the start of the following round after the time reaches zero.

20 Claims, 7 Drawing Sheets

ELECTRONIC POKER GAMEPLAY APPARATUS AND GAMING TOKEN SET USABLE WITH THE GAMEPLAY APPARATUS

FIELD OF THE INVENTION

The present invention relates to an apparatus for assisting in the gameplay of a game of poker, and more particularly relates to a gameplay apparatus for determining pot value based on the weight of the gaming tokens. The present invention further relates to a unique set of gaming tokens which are usable with the gameplay apparatus for determining pot value.

BACKGROUND

In the game of poker, players place gaming tokens onto the center of a table to make a wager or match another players wager. Throughout each round of gameplay, the collection of gaming tokens in the center of the table forms what is known as the poker pot. The winner of each round collects all gaming tokens that were accumulated in the pot during the respective round. The gaming tokens used in the game are assigned monetary values. Poker is often played inside of casinos, however, sets are also manufactured and sold to the home market for games to be played outside of casinos. There are aspects of the game of poker than can be improved with additional information gathering sensors and displaying devices included in a poker set. These improvements will allow users to be able to make more knowledgeable decisions during gameplay. The improvements will also increase the speed of the game and make the game more interesting.

One important piece of information during a game of poker is the combination of the assigned monetary values of all gaming tokens in the pot at any given time (otherwise known as the pot value). Poker sets sold for use outside of casinos do not include any sensors, thus the pot value is determined manually by summing the monetary values of each token in the pot. Often times, the exact pot value goes unknown throughout each round. Counting the pot value is a time consuming process that often interferes with the flow of the game. The pot value is important to know because knowledgeable wagers are based off of the reward that can be gained if the round is won. It also adds interest to the game for players to know exactly what can be won at the end of each round.

There are a number of disclosed systems that do not use weigh sensors to identify the tokens formed in the pot. Some of these systems include RFID tokens, magnetic sensors and/or optical sensors. These devices are costly and are aimed at the casino market rather than for players to own a set of their own, as they are too expensive to be competitive for the home poker game market.

A weight sensor is a low cost alternative. U.S. Pat. No. 8,157,643B1 and U.S. Pat. No. 5,451,054 disclose devices that have specifically assigned weigh sensors for the different monetary values assigned to the gaming tokens. The user is required to collect tokens that have the same monetary value and place them onto the correctly assigned weigh sensor platform. Assigned platforms are not ideal for a poker pot application as it would be time consuming to organize each wager and collect tokens that have the same monetary values. It is easier and faster to place all the gaming tokens into the same location without the need to organize the tokens.

Other systems identified in U.S. Pat. No. 7,351,145 B1 and U.S. Patent application 20160071367A1 describe specifically weighted tokens such that no two combinations of tokens would result in the same weight as a different combination of tokens. These devices use a "look up table", where each specific weight will correspond to a unique combination of gaming tokens. These devices work best when the wagers consist of a small number of tokens. In a poker pot, the number of tokens can exceed 150 different tokens. Uniquely weighted combinations for a high number of tokens results in weight combinations that are very close in weight. As a result, the sensor must be extremely accurate as a deviation from the actual weight could result in an extremely different reading in pot value (the error in the pot value reading is not proportional to the error in the sensor reading).

Therefore, there is still a need for a system that uses low cost sensors that do not require a high level of accuracy. Poker sets sold to the home market use gaming tokens that are shaped similar to those used in the casinos. As a result, it is ideal that the poker set includes gaming tokens that are similar in shape as the tokens used in the casinos. There are two types of tokens used most in casinos. The first is a poker chip which is generally in the form of a thin, cylindrical shape. The second is a poker plaque which is larger in size than the poker chip is thin and generally rectangular is perimeter shape.

Another important piece of information in the game of poker is knowing the total value added to the pot after a wager is made. When a player wagers all of their remaining gaming tokens, the total value of the wager is often unknown. As a result, the gaming tokens must be counted manually to determine the value of the wager before the following player can match the wager. This is also a time consuming process that often slows the flow of the game.

At the start of each round during poker gameplay, certain players are forced to wager a certain value of gaming tokens. The forced wagers are known as the blinds. The value of the blinds increases over a set length of time. The value of the blinds continues to increase in intervals throughout the entire game to ensure that the game ends within a reasonable amount of time. Another important piece of information in the game of poker is the time remaining until the value of the blinds needs to be increased. Currently, the time remaining until the value of the blinds needs to be increased is kept track of using a timer with an alarm. When the time reaches the end of the set length of time, the value of the blinds does not change until the round is completed. If players are in the middle of a round when the time alarm is activated, then they must wait until the round has completed before the resetting the timer. There is a time difference from when the timer alarm is activated to when the round ends. As a result, players often forget to reset the timer at the end of the round. It is beneficial for a timer to be incorporated with the gameplay such that the timer automatically resets once the round is completed.

SUMMARY OF THE INVENTION

According to one aspect of the present invention there is provided an apparatus for use with a plurality of gaming tokens comprising either poker chips or poker plaques including a first set of first monetary value tokens each having a prescribed first weight and having a first assigned monetary value and a second set of second monetary value tokens each having a prescribed second weight and having a second assigned monetary value, the apparatus comprising:

a receptacle arranged to receive the gaming tokens therein;

a scale operatively connected to the receptacle so as to generate a weight signal representing a combined weight of the gaming tokens within the receptacle;

an output device for communication with a user;

a computer controller in communication with the scale and the output device, the computer controller including (i) a memory storing programming instructions and a monetary value constant thereon which represents a ratio between a weight of any gaming token and the assigned monetary value of that gaming token and (ii) a processor for executing the programming instructions so as to be arranged to:

(i) receive the weight signal from the scale which represents the combined weight of the gaming tokens within the receptacle;

(ii) calculate a pot value which is a combination of the assigned monetary values of all gaming tokens within the receptacle using the weight signal and the monetary value constant; and (iii) outputting the pot value to the output device such that the output device communicates the pot value to the user.

Preferably, the monetary value constant stored on the computer controller is programmably adjustable.

The computer controller may include at least one button, wherein said at least one button can control settings, one of such settings is to change the monetary value constant.

The programming instructions stored on the computer controller may be further arranged to perform a calculation to determine a total combination of the assigned monetary values of gaming tokens added to the pot after each player addition is made in a game of poker by comparing the pot value before and after the player addition is made and to communicate the total combination of the assigned monetary values of gaming tokens added to the output device for communication to the user. The calculation may use a time delay between comparing the pot value before and after the player addition is made, and wherein a longer delay is provided for additions above a prescribed threshold a smaller or no delay is provided for additions below the prescribed threshold.

The computer controller may include a timer counting down from a set length of time and automatically resetting back to the set length of time after both of the following conditions are satisfied: (i) said timer has counted down to zero; and (ii) the measured weight of tokens within the receptacle is below a threshold limit indicative that there are no tokens remaining in the receptacle.

The computer controller may include a transceiver capable of wirelessly communicating with personal computer devices associated with each player in a game of poker, and wherein the programming instructions are arranged such that each personal computer device is arranged to receive information wirelessly from the computer controller for display on the personal computer devices. In this instance, the programming instructions may include transmitting notifications relating to which player's turn it is to the personal computer devices according to rules of the game of poker. The information transmitted wirelessly from the computer controller to the personal computer devices may also include (i) a total monetary value required to wager in order to match the highest wager made from another player in the associated round, and/or (ii) a percentage of the total monetary value required to wager in order to match the highest wager made from another player in the associated round in comparison with the pot value according to rules of the game of poker.

The apparatus is preferably used in combination with the plurality of gaming tokens wherein: (i) the first set of the first monetary value tokens each having a first appearance indicative of the first assigned monetary value; (ii) the second set of second monetary value tokens each having second appearance indicative of the second assigned monetary value; (iii) the second appearance being different from the first appearance such that the second monetary value tokens are visually distinguishable from the first monetary value tokens; and (iv) a ratio between a weight of any gaming token and the assigned monetary value of that gaming token defining the monetary value constant in which the monetary value constant is identical among all gaming tokens of the gaming token set.

According to a second aspect of the present invention there is provided a gaming token set comprising:

a plurality of gaming tokens in which each gaming token defines either a poker chip or a poker plaque;

the plurality of gaming tokens including a first set of first monetary value tokens each having a prescribed first weight and having a first assigned monetary value and having a first appearance indicative of the first assigned monetary value; and the plurality of gaming tokens including a second set of second monetary value tokens each having a prescribed second weight and having a second assigned monetary value and having a second appearance indicative of the second assigned monetary value;

the second appearance being different from the first appearance such that the second monetary value tokens are visually distinguishable from the first monetary value tokens;

a ratio between a weight of any gaming token and the assigned monetary value of that gaming token defining a monetary value constant in which the monetary value constant is identical among all gaming tokens of the gaming token set.

Preferably a basic weight unit is evenly divisible into the weight of each of the first and second monetary value tokens of the gaming token set.

In some instance, the prescribed second weight is an exact multiple of the prescribed first weight.

Preferably the first monetary value tokens and the second monetary value tokens are identical in size and shape relative to one another.

When the prescribed first weight of the first monetary value tokens is less than the prescribed second weight of the second monetary value tokens, each first monetary value token may have a core formed of a core material which is less dense than a boundary material of first monetary value token and less dense than a core material of each second monetary value token.

Alternatively, when the prescribed first weight of the first monetary value tokens is less than the prescribed second weight of the second monetary value tokens, each first monetary value token has at least one hollow cavity formed which is not present in each second monetary value token.

In a further arrangement, when the prescribed first weight of the first monetary value tokens is less than the prescribed second weight of the second monetary value tokens, each first monetary value token is primarily formed of a foamed material which is less dense than a material primarily forming each second monetary value token.

The plurality of gaming tokens may also include a third set of third monetary value tokens each having a prescribed third weight and having a third assigned monetary value and having a third appearance indicative of the third assigned monetary value, the third monetary value tokens being different in size and shape relative to the first and second monetary value tokens.

Alternatively, when the prescribed first weight of the first monetary value tokens is less than the prescribed second weight of the second monetary value tokens, each first monetary value token may be poker chip having a thin, generally cylindrical shape, and each second monetary value token may be a poker plaque which is (i) larger in size than the poker chip, (ii) generally rectangular in perimeter shape, and (iii) formed so as to include a core material fully surrounded by a boundary which is less dense than the core material.

BRIEF DESCRIPTION OF THE FIGURES

The drawings are briefly described as follows.

DETAILED DESCRIPTION

Figure 1A:
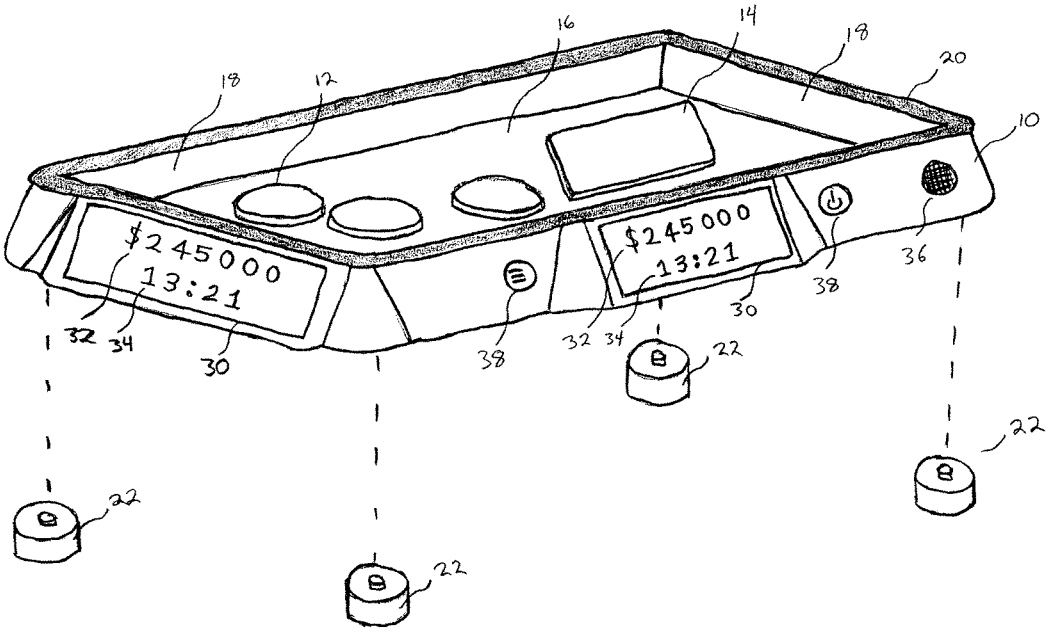
FIG. 1A shows a perspective view of gaming tokens inside a receptacle arranged to receive gaming tokens therein. It also shows some of the electronic devices operatively connected to the receptacle.
Figure 1B:
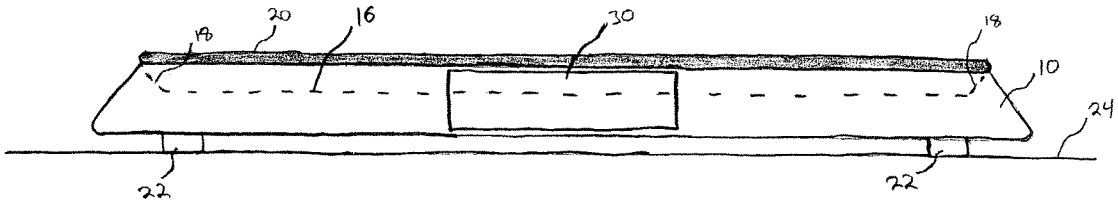
FIG. 1B shows a side view of the gaming token receiving receptacle. It also shows some of the electronic devices operatively connected to the gaming token receiving receptacle.

The described embodiment in FIG. 1A and FIG. 1B consists of the following items. The first is a receptacle 10 arranged to receive gaming tokens therein. The gaming token receiving receptacle 10 is placed in the center of a table 24 and contains all tokens formed in the pot. Gaming tokens, which are ideal to be in the form of a poker chip 12, or a poker plaque 14, are to be placed into the gaming token receiving receptacle 10 during gameplay when there is an addition to the pot. The poker chip 12 is generally in the form of a thin, cylindrical shape and the poker plaque 14 is larger in size than the poker chip and is generally thin and rectangular is perimeter shape. Other shapes of gaming tokens can be used to be functional with the game of poker, however, it is ideal for the shape to be either a poker chip 12 or a poker plaque 14 to match the shape of gaming tokens used in casinos.

The gaming token receiving receptacle 10 has a flat surface 16 on top so that the tokens can be stacked onto it in order to maximize the number of tokens that can be placed within the token receiving receptacle 10. The edges of the container are angled walls 18 which prevent the tokens from spilling over/out, but also allows the tokens to be easily removed from the gaming token receiving receptacle 10 device at the end of each round. A rubber tube 20 or some other high friction material is placed on the top edge of the angled walls 18 to help contain the gaming tokens within the receptacle 10.

Figure 2:
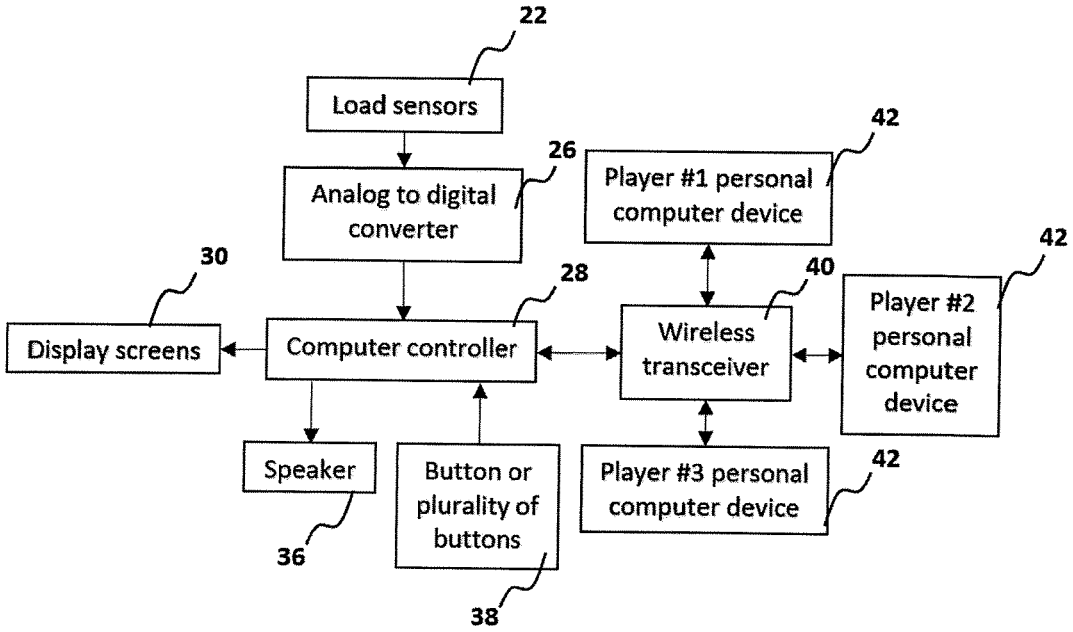
FIG. 2 depicts a block diagram to show the electronic devices and how they are connected to each other.
Figure 3:
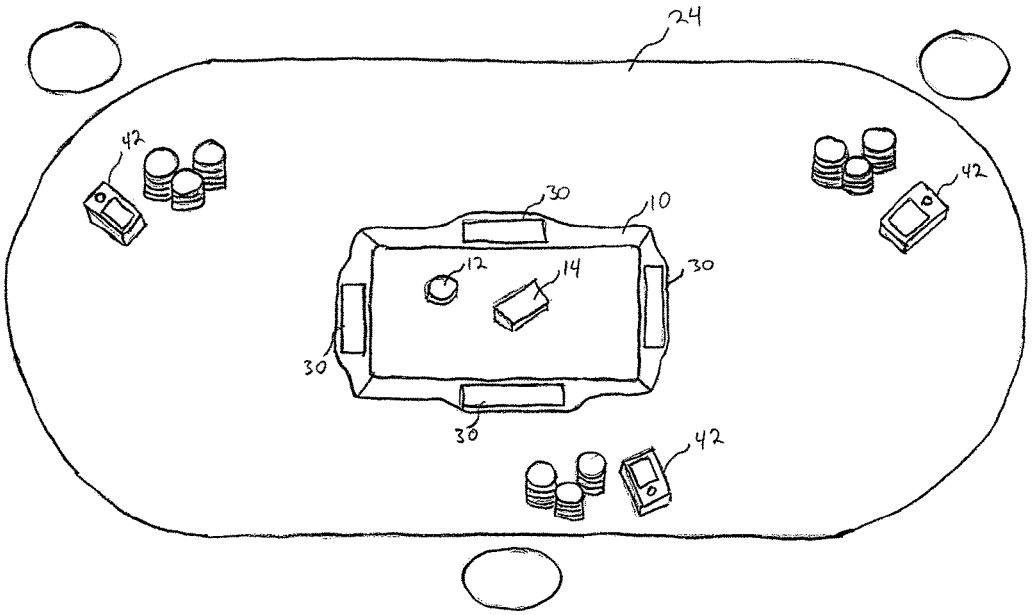
FIG. 3 is an illustration of the gaming token receiving receptacle on a gaming table to show how it is arranged relative to the players.

A block diagram shown in FIG. 2 shows the electronic devices within the receptacle 10 and how the electronic devices are connected to each other. A scale is operatively connected to the gaming token receiving receptacle 10. A weight signal is generated using a load cell sensor or plurality of load sensors 22 placed beneath the token receiving receptacle 10. The weight signal represents a combined weight of the gaming tokens received in the receptacle 10. An analog to digital converter 26 converts the signal generated by the load cell sensors 22 into a digital signal. The digital signal is then processed by a computer controller 28 having a memory storing programming instructions thereon executable by a processor to effect the various functions.

Display screens 30 are placed around the gaming token receiving receptacle 10. The display screens are used as an output device to communicate data to the users. A display screen is one type of output device for communicating data to users, however other types of output devices are contemplated such as a speaker, or a transmitter to transmit data to a separate device such as a player's mobile device. One piece of data communicated to all players is the summation of the values of all gaming tokens in the pot 32 otherwise known as the pot value. Another piece of data communicated is the time remaining until the value of the blinds needs to be increased 34. A speaker 36 is placed within the token receiving receptacle 10 and a button or plurality of buttons 38 are present on the outside of the token receiving receptacle 10 for players to control the settings.

The embodiment can include a transceiver 40 capable of wirelessly communicating with personal computer devices 42 associated with each player in a game of poker.

Each gaming token is assigned a monetary value. The tokens are assigned values to allow players to wager by placing the tokens in the center of the table. The gaming token set includes a first set of first monetary value tokens each having a prescribed first weight and having a first assigned monetary value. The gaming tokens set also includes a second set of second monetary value tokes each having a prescribed second weight and having a second assigned monetary value. The gaming token set can further include additional sets of different monetary value tokens. The gaming tokens are manufactured such that the ratio between a weight of any gaming token and the assigned monetary value of that gaming token is identical among all gaming tokens of the gaming token set. The assigned monetary value of any given gaming token divided by the weight of the gaming token is defined as the monetary value constant. As a result, the monetary value constant is identical among all gaming tokens in the gaming token set.

More specifically, the gaming tokens need to be manufactured such that the ratio of weights between different monetary value tokens match the ratios of monetary values commonly assigned to gaming tokens in poker games. An example of monetary values assigned to five different monetary value tokens used in a poker game is $1, $2, $5, $10 and $20 for five different monetary value tokens respectively. In this example, the manufactured weights of the tokens would have to be such that the second monetary value token is twice the weight of the first monetary value token, the third monetary value token is 5 times weight of the first monetary value token, the fourth monetary value token is 10 times the weight of the first monetary value token, and the fifth monetary value token is 20 times the weight of the first monetary value token. Other monetary values and associated weight ratios can be used as long as the monetary value constant is identical among all gaming tokens in the gaming token set. There is a limit on the different monetary values that can be assigned to the gaming tokens as the weight ratios can become too extreme, resulting in awkwardly sized and weighted gaming tokens. Also, five different monetary value tokens are not required as a different number of different monetary value tokens can be used.

Each gaming token has an appearance that is indicative of the assigned monetary value of the token. The appearance of gaming tokens from different monetary value sets differs such that gaming tokens that have different assigned monetary values are visually distinguishable. The gaming tokens are not required to have monetary values inscribed onto them. The assigned monetary value of a token will become visible on a display screen 30 if it is solely placed within the gaming token receiving receptacle 10.

It is ideal but not restricting for all gaming tokens to have the same thickness so that two stacks with an equal number of gaming tokens will have the same total height, even if the stacks consist of different monetary value tokens. As a result, player can still manually count the number of gaming tokens in a stack by matching the height of another stack where the second stack has a known number of gaming tokens. It is also ideal but not restricting for all poker chips 12 to have the same diameter so that a stack of poker chips will not have any chips that stick out, even if the stack consists of different monetary value tokens. It is also ideal for all gaming tokens to have a similar surface texture.

Figure 4A:
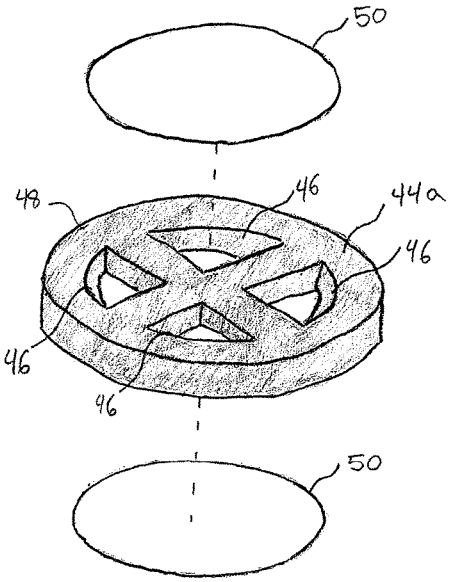
FIG. 4A-4D is an illustration of modifications that can be made to a poker chip in order to reduce the weight without changing the diameter or thickness of the chip.
Figure 4B:
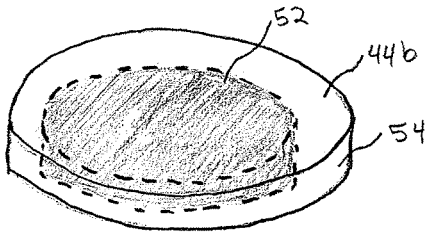
Figure 4C:
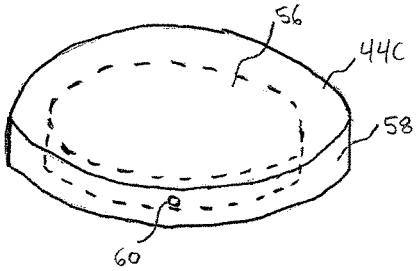
Figure 4D:
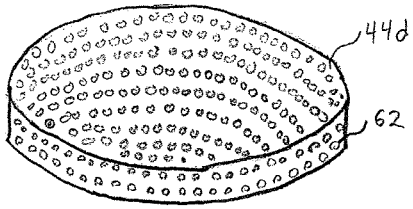

Modifications to the design of existing gaming tokens will likely need to be implemented in order to achieve the desired weight ratios. A poker chip 12 that is the same size and shape as all other poker chips in the set and is manufactured from injected molded plastic will likely be too heavy to achieve the desired weight ratios. The goal is to reduce the weight of the lightest gaming token without reducing the diameter or thickness. The weight reduction can be accomplished as presented in FIG. 4A-4D. FIG. 4A shows a gaming token with the lowest assigned monetary value in the gaming token set 44*a* where the gaming token 44*a* is in the form of a poker chip 12. The gaming token 44*a* has cavities 46 formed within the perimeter 48 of the gaming token. The cavities can be any shape and size, reducing the material present within the outer perimeter 48 of the gaming token 44*a*. The gaming token 44*a* can still consist of injection molded plastic and be lighter than a gaming token with a higher assigned monetary value that does not contain the cavities. Stickers 50 can be placed on one side or both sides of the gaming token 44*a* to cover up the cavities 46. FIG. 4B shows a different method to reduce the weight of the lowest assigned monetary value in the gaming token set 44*b*. The gaming token 44*b* has a core 52 formed of a core material which is less dense than a boundary material 54 that surrounds the core 52. As a result, the boundary material 54 can still be injected molded plastic, so long as the core 52 consists of a lighter density material. The core 52 can be formed of wood, cork or a foamed material to name a few feasible materials with a lighter density than injection molded plastic. The boundary material 54 can be identical the primary material used in gaming tokens with a higher assigned monetary value, resulting in identical surface textures between the different monetary value tokens. FIG. 4C shows a different method to reduce the weight of the lowest assigned monetary value in the gaming token set 44*c*. The gaming token 44*c* contains at least one hollow cavity 56 formed therein which is fully surrounded by a boundary material 58. The hollow cavity 56 can be formed from a blow molding process. There would be an opening in the token 60 that an air nozzle would enter into while forming the gaming token 44*c*. FIG. 4D shows a different method to reduce the weight of the lowest assigned monetary value in the gaming token set 44*d*. The gaming token 44*d* contains gas bubbles 62 as it is formed from a foamed material which is less dense that the primary materials used in each of the gaming tokens with a higher assigned monetary value. The gaming tokens with the highest assigned monetary value can be in the form of a poker plaque 14. The plaque 14 can be formed so as to include a core material fully surrounded by a boundary material which is less dense that the core material. The poker plaque 14 is larger in shape than the poker chip, which allows for the poker plaque 14 to be easily heavier than a gaming token with a lower assigned monetary value.

OPERATION

Figure 5:
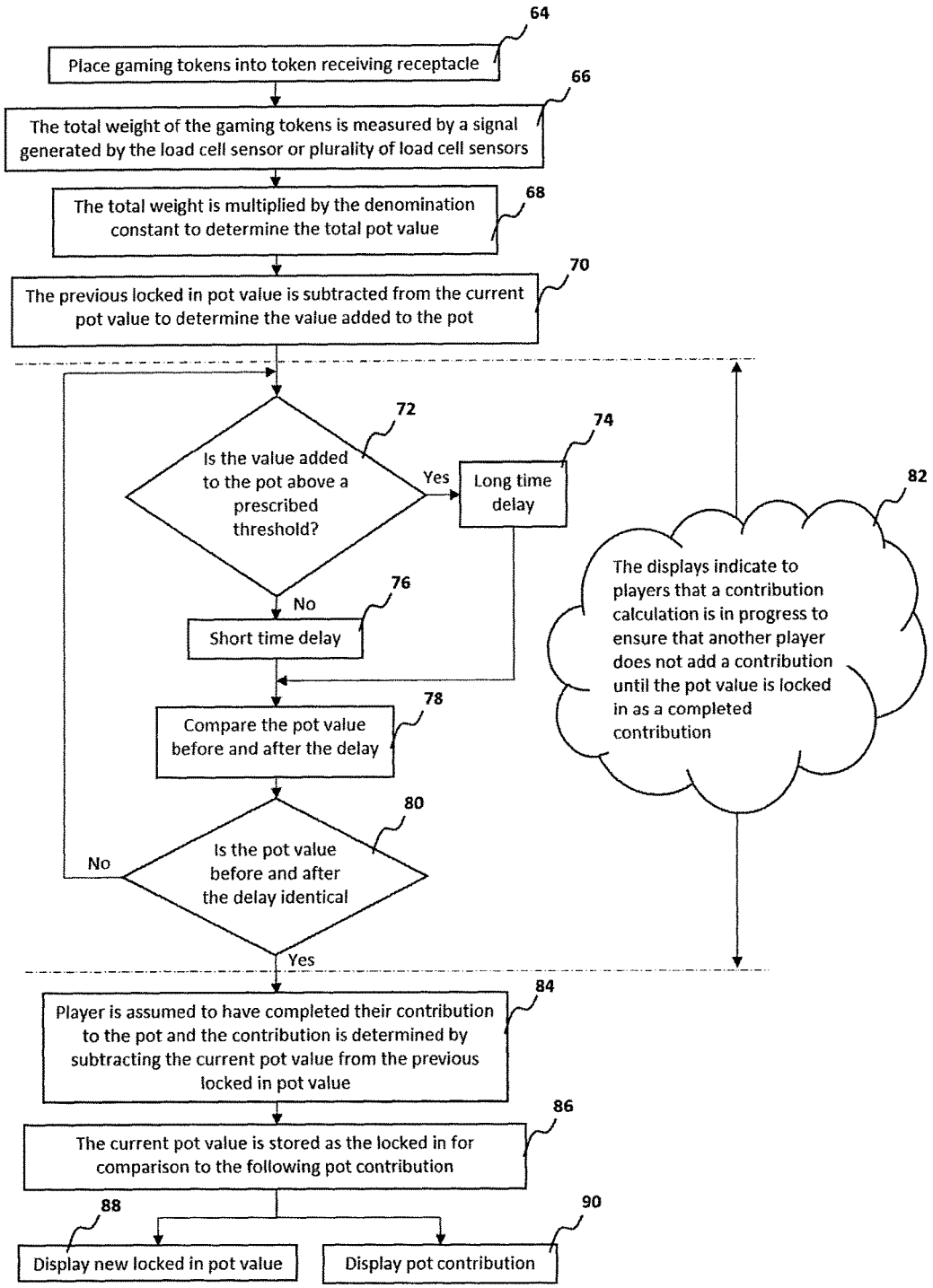
FIG. 5 depicts a flow chart useful in explaining the steps that would occur when a player adds gaming tokens to the gaming token receiving receptacle.

FIG. 5 depicts a flow chart of the steps that would occur when a player adds gaming tokens into the gaming token receiving receptacle 10. During poker gameplay, players place gaming tokens into the gaming token receiving receptacle 64 when there is an addition to the poker pot. The total weight of the gaming tokens is then measured by a signal generated from the load cell sensor or plurality of load cell sensors 66. The pot value is then determined by multiplying the total measured weight by the monetary value constant 68. The total value of gaming tokens that have been added to the pot is then determined. The total value of tokens added to the pot by the previous player is defined as the pot contribution. A large pot contribution may contain too many gaming tokens to be added into the gaming token receiving receptacle 10 with a single handful. Thus, multiple handfuls are used to place then entire contribution into the receptacle 10. The programming instructions stored on the computer controller 28 must arranged to be able to differentiate between a pot contribution consisting of multiple handfuls added to the receptacle 10 and two different pot contributions where the second contribution is added quickly after the first.

Immediately after the previous player has made a contribution to the pot, the computer controller 28 stores the pot value as the locked in pot value 86. The locked in pot value is used in comparison to the following additions to the pot. When the following player adds tokens into the receptacle, the computer controller 28 compares the pot value reading to the previous locked in pot value reading to determine the contribution 70. The computer controller 28 then evaluates if the contribution is above or below a prescribed threshold 72. If the contribution is above a prescribed threshold (indicating that it would likely take multiple handfuls to place all tokens into the receptacle 10) then there would be a long time delay 74. The long time delay is long enough to provide adequate time for the player to add additional handful of gaming tokens before the pot value is locked in and the contribution is assumed to be completed. If the measured contribution is below the prescribed threshold (indicating that a small contribution has been made and it is likely that it could have been completed with a single handful of gaming tokens) then there would be a short time delay 76. The short time delay is short enough so that the pot value would be locked in before the next player is able to add their contribution. After the time delay is completed, the computer controller 28 compares the pot value reading to the previous locked in pot value reading 78 to determine if the contribution reading is identical to the contribution reading before the time delay 80. If the contribution reading has changed then there will be a loop of time delays and contribution readings until the contribution reading before and after the time delay is identical. When the contribution reading is identical before and after the time delay, the computer controller 28 will store the pot value as the locked in pot value 84 which will be used as the comparison for the next contribution. During the time delay loop process, the displays 30 can indicate to players that a contribution calculation is in progress to ensure that another player does not add a contribution until the pot value is locked in as a completed contribution 82. The indication that the contribution calculation is in progress could be for example displaying the word "calculating". Other indications or no indication at all can also be used.

The pot value 88 and pot contribution 90 are communicated to all players. Both values can be displayed at the same time. It is also possible to rotate between displaying the two values on the same display 30. Other methods of communicating the values can also be used such as an audible message.

At the start of each round during poker gameplay, certain players are forced to wager a certain value of gaming tokens. The forced wagers are known as the blinds. The value of the blinds increases over a set length of time. The value of the blinds continues to increase in intervals throughout the entire game to ensure that the game ends within a reasonable amount of time. The computer controller 28 also keeps track of the time remaining until the value of the blinds needs to be increased. When the game is started, a timer starts counting down from a set length of time. The time remaining 34 is communicated back to the players on a display 30. A display screen is one type of output device for communicating the time to users, however other types of output devices are contemplated such as a speaker, or a transmitter to transmit data to a separate device such as a player's mobile device. When the timer reaches zero, the players are notified that the timer has ended. The notification is to inform players that the blinds are due for an increase the following round. If there are gaming tokens within the gaming token receiving receptacle 10, then players are in the middle of a round and the timer will remain at zero until the round is completed. The computer controller 28 can determine if there are no gaming tokens within the receptacle 10 if the measured weight is below a threshold limit. The timer will automatically reset to the set length of time once the timer has counted down to zero and the measured weight of tokens within the receptacle 10 is below a threshold limit. Players will be notified again once the timer is reset as a reminder to increase the value of the blinds.

One of the buttons 38 can be used to control the timer by allowing a player to pause, resume and reset the timer as desired. One of the buttons 38 can be used to adjust some of the programming settings. The players can programmably adjust the set length of time for the blinds. The players can also programmably adjust the value of the monetary value constant. Once the monetary value constant is adjusted, the assigned monetary value of all tokens will also change simultaneously. The assigned monetary values will all change by the same factor that the monetary value constant is changed by. As an example, consider five different monetary value tokens with assigned monetary values $1, $2, $5, $10, $20 for the five monetary value tokens respectively. The monetary values assigned to the five different monetary value tokens can be changed to $5, $10, $25, $50, $100 for the five monetary value tokens respectively by increasing the monetary value constant by a factor of 5. The assigned monetary value of each gaming token increases by a factor of 5, thus the monetary value constant remains identical among all gaming tokens of the gaming token set.

In the game of poker, a side pot is formed when one player wagers all of their remaining gaming tokens and at least two other players match the wager with additional tokens remaining. If the other players continue to wager, they do so in a separately formed pot known as the side pot. The player with no tokens remaining cannot win the tokens formed in the side pot. One of the buttons 38 can be used to store the pot value at the time that the button was pressed as an indication of the total value of tokens that the player with no tokens remaining can win. Any additional tokens added within the token receiving receptacle 10 will be added separately as an indication of the total value in the side pot. The total value of gaming tokens in the side pot is displayed and the total value of gaming tokens that the player with no tokens remaining can win is displayed.

One of the buttons 38 can be used to turn the electronic devices on and off. If there is not a change in measured weight for a predetermined amount of time, then the electronic devices will automatically turn off.

One of the buttons 38 can be used to change the measured weight to zero by storing the weight measured at the time that the button is pressed. If at any time, the weight signal generated by the load cell sensors 22 indicates that there is a negative weight, then the computer controller 28 will automatically change the measured weight to zero. Also, at the end of each round after all tokens have been removed from the token receiving receptacle 10, the computer controller 28 can automatically change the measured weight to zero. The end of the round can be determined when the measured weight goes from beyond a preselected threshold weight to below a preselected threshold weight, thus indicating that all gaming tokens have been removed from the gaming token receiving receptacle 10.

Figure 6:
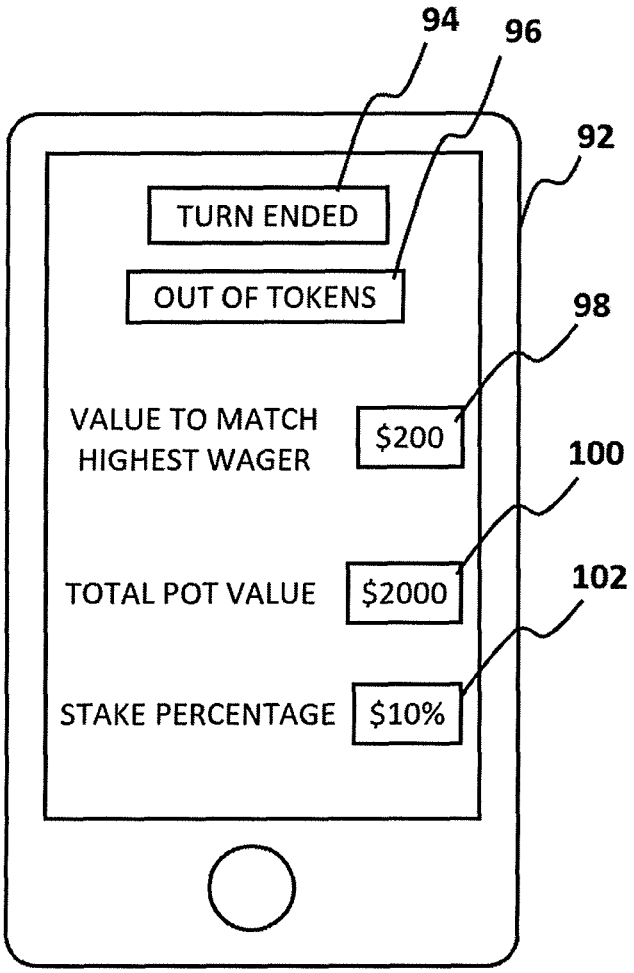
FIG. 6 is an illustration of a personal computer device that can interact with a transceiver within the gaming token receiving receptacle. It depicts various inputs and outputs provided on the personal computer device.

Another feature that can be included but is required is to have a transceiver 40 capable of wirelessly communicating with personal computer devices associated with each player during the game of poker. The personal computer devices 42 used can be a mobile phone 92 as shown in FIG. 6. At the start of the game, all players connect their wireless personal computer devices 42 with the transceiver 40. The players can wirelessly interact with the computer controller 28 via an application on their wireless personal computer devices. The programming instructions are arranged such that each personal computer device 42 can receive information wirelessly from the computer controller 28 for display on the personal computer devices 42. The number of players actively playing can be determined based on the number of devices connected to the transceiver 40. At the start of the game, one player will need to indicate that they are the first person to play by pressing a button on their personal computer device 42. The computer controller can determine that a player's turn has ended their turn once a pot contribution is completed. If a player chooses not to wager, then they will be required to manually press a button 94 to indicate that their turn has ended. Players will also be required to indicate if they are no longer in play with no gaming tokens remaining 96. As a result, the computer controller 28 can keep track of whose turn it is. If it is a players turn to wager, their personal computer device 42 will provide a notification that it is their turn by for example buzzing or performing some visual indication. The computer controller 28 can store the value of each contribution made by each player in a round. The computer controller 28 can also store which player made the contribution based on whose turn it was when the contribution was made. As a result, the computer controller 28 can determine the required value that a player needs to add to the pot in order to match the highest wager made from another player in the associated round 98. The required wager value for a player is determined by subtracting the total value the player has contributed to the pot from the highest total wager made from another player in the associated round. Both pieces of information are important because during a home game of poker, players are often confused whose turn it is and how much they are required to add to the pot to match the wagers from other players.

In addition, the application on the personal computer devices will be able to indicate the pot value 100 and the stakes for matching the current wager in the form of a percentage 102. As an example, if $10 is required to wager in order to match the highest wager from another player in the associated round into a pot that already $100 in it, then then percentage displayed is 10%. The percentage allows for better decision making as the risk versus reward becomes visual.

I claim:

1. An apparatus for use with a plurality of gaming tokens comprising either poker chips or poker plaques including a first set of first monetary value tokens each having a prescribed first weight and having a first assigned monetary value and a second set of second monetary value tokens each having a prescribed second weight and having a second assigned monetary value, the apparatus comprising:

a receptacle arranged to receive the gaming tokens therein;

a scale operatively connected to the receptacle so as to generate a weight signal representing a combined weight of the gaming tokens within the receptacle;

an output device for communication with a user;

a computer controller in communication with the scale and the output device, the computer controller including (i) a memory storing programming instructions and a monetary value constant thereon which represents a ratio between a weight of any gaming token and the assigned monetary value of that gaming token and (ii) a processor for executing the programming instructions so as to be arranged to:

(i) receive the weight signal from the scale which represents the combined weight of the gaming tokens within the receptacle;

(ii) calculate a pot value which is a combination of the assigned monetary values of all gaming tokens within the receptacle using the weight signal and the monetary value constant; and (iii) outputting the pot value to the output device such that the output device communicates the pot value to the user.

2. The apparatus according to claim 1 wherein the monetary value constant stored on the computer controller is programmably adjustable.

3. The apparatus according to claim 2 wherein the computer controller includes at least one button, wherein said at least one button can control settings, one of such settings is to change the monetary value constant.

4. The apparatus according to claim 1 wherein the programming instructions stored on the computer controller are further arranged to perform a calculation to determine a total combination of the assigned monetary values of gaming tokens added to the pot after each player addition is made in a game of poker by comparing the pot value before and after the player addition is made and to communicate the total combination of the assigned monetary values of gaming tokens added to the output device for communication to the user.

5. The apparatus according to claim 4 wherein said calculation uses a time delay between comparing the pot value before and after the player addition is made, and wherein a longer delay is provided for additions above a prescribed threshold a smaller or no delay is provided for additions below the prescribed threshold.

6. The apparatus according to claim 1 wherein the computer controller includes a timer counting down from a set length of time and automatically resetting back to the set length of time after both of the following conditions are satisfied:

(i) said timer has counted down to zero; and (ii) the measured weight of tokens within the receptacle is below a threshold limit indicative that there are no tokens remaining in the receptacle.

7. The apparatus according to claim 1 wherein the output device comprises a personal computer device associated with each player in a game of poker and wherein the computer controller includes a transceiver capable of wirelessly communicating with the personal computer devices, and wherein the programming instructions are arranged such that each personal computer device is arranged to receive information wirelessly from the computer controller for display on the personal computer devices.

8. The apparatus according to claim 7 wherein the programming instructions include transmitting notifications relating to which player's turn it is to the personal computer devices according to rules of the game of poker.

9. The apparatus according to claim 7 wherein the information transmitted wirelessly from the computer controller to the personal computer devices includes a total monetary value required to wager in order to match the highest wager made from another player in the associated round according to rules of the game of poker.

10. The apparatus according to claim 7 wherein the information transmitted wirelessly from the computer controller to the personal computer devices includes a percentage of the total monetary value required to wager in order to match the highest wager made from another player in the associated round in comparison with the pot value according to rules of the game of poker.

11. The apparatus according to claim 1 in combination with the plurality of gaming tokens wherein:

the first set of the first monetary value tokens each having a first appearance indicative of the first assigned monetary value; and the second set of second monetary value tokens each having second appearance indicative of the second assigned monetary value;

the second appearance being different from the first appearance such that the second monetary value tokens are visually distinguishable from the first monetary value tokens; and a ratio between a weight of any gaming token and the assigned monetary value of that gaming token defining the monetary value constant in which the monetary value constant is identical among all gaming tokens of the gaming token set.

12. A gaming token set comprising:

a plurality of gaming tokens in which each gaming token defines either a poker chip or a poker plaque;

the plurality of gaming tokens including a first set of first monetary value tokens each having a prescribed first weight and having a first assigned monetary value and having a first appearance indicative of the first assigned monetary value; and the plurality of gaming tokens including a second set of second monetary value tokens each having a prescribed second weight and having a second assigned monetary value and having a second appearance indicative of the second assigned monetary value;

the second appearance being different from the first appearance such that the second monetary value tokens are visually distinguishable from the first monetary value tokens;

a ratio between a weight of any gaming token and the assigned monetary value of that gaming token defining a monetary value constant in which the monetary value constant is identical among all gaming tokens of the gaming token set.

13. The gaming token set according to claim 12 wherein a basic weight unit is evenly divisible into the weight of each of the first and second monetary value tokens of the gaming token set.

14. The gaming token set according to claim 12 wherein the prescribed second weight is an exact multiple of the prescribed first weight.

15. The gaming token set according to claim 12 wherein the first monetary value tokens and the second monetary value tokens are identical in size and shape relative to one another.

16. The gaming token set according to claim 15 wherein the plurality of gaming tokens includes a third set of third monetary value tokens each having a prescribed third weight and having a third assigned monetary value and having a third appearance indicative of the third assigned monetary value, the third monetary value tokens being different in size and shape relative to the first and second monetary value tokens.

17. The gaming token set according to claim 15 wherein the prescribed first weight of the first monetary value tokens is less than the prescribed second weight of the second monetary value tokens and wherein each first monetary value token has a core formed of a core material which is less dense than a boundary material of first monetary value token and less dense than a core material of each second monetary value token.

18. The gaming token set according to claim 15 wherein the prescribed first weight of the first monetary value tokens is less than the prescribed second weight of the second monetary value tokens and wherein each first monetary value token has at least one hollow cavity formed which is not present in each second monetary value token.

19. The gaming token set according to claim 15 wherein the prescribed first weight of the first monetary value tokens is less than the prescribed second weight of the second monetary value tokens and wherein each first monetary value token is primarily formed of a foamed material which is less dense than a material primarily forming each second monetary value token.

20. The gaming token set according to claim 15 wherein the prescribed first weight of the first monetary value tokens is less than the prescribed second weight of the second monetary value tokens, wherein each first monetary value token is a poker chip having a thin, generally cylindrical shape, and wherein each second monetary value token is a poker plaque which is (i) larger in size than the poker chip, (ii) generally rectangular in perimeter shape, and (iii) formed so as to include a core material fully surrounded by a boundary which is less dense than the core material.

* * * * *